US006886908B2

(12) United States Patent
Takahashi et al.

(10) Patent No.: US 6,886,908 B2
(45) Date of Patent: May 3, 2005

(54) LIQUID EJECTING APPARATUS

(75) Inventors: Tomoaki Takahashi, Nagano-Ken (JP); Takayuki Togashi, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/417,331

(22) Filed: Apr. 17, 2003

(65) Prior Publication Data

US 2004/0027412 A1 Feb. 12, 2004

(30) Foreign Application Priority Data

Apr. 18, 2002 (JP) ..... 2002-116402
Nov. 29, 2002 (JP) ..... 2002-348189

(51) Int. Cl.[7] ..... B41J 2/165
(52) U.S. Cl. ..... 347/34
(58) Field of Search ..... 347/31, 32, 33, 347/34, 37, 39, 22

(56) References Cited

U.S. PATENT DOCUMENTS 6,203,152 B1 * 3/2001 Boleda et al. ..... 347/102
6,709,088 B2 * 3/2004 Hayakawa et al. ..... 347/31
2002/0003554 A1 * 1/2002 Hayakawa et al. ..... 347/31

FOREIGN PATENT DOCUMENTS

| | | | |
|---|---|---|---|
| JP | 9-309200 | * 12/1997 | ..... B41J/29/377 |
| JP | 2000-263814 A | 9/2000 | |
| JP | 2002-166575 A | 6/2002 | |
| JP | 2002-205415 A | 7/2002 | |
| JP | 2002-234152 A | 8/2002 | |
| JP | 2002-307725 A | 10/2002 | |

* cited by examiner

*Primary Examiner*—Huan Tran
(74) *Attorney, Agent, or Firm*—Sughrue Mion, PLLC

(57) ABSTRACT

The liquid ejecting apparatus includes: a liquid jet head including a nozzle opening through which a liquid drop is ejected by changing pressure of a liquid in a pressure chamber interconnecting to the nozzle opening; a scanning mechanism including a carriage on which the liquid jet head is loaded, the scanning mechanism moves the liquid jet head in a head scanning direction together with the carriage; a case configured to contain the liquid jet head and the scanning mechanism; and a leading unit for leading a liquid drop, which is ejected from the liquid jet head and not applied to an article to be processed, in a given direction using an air stream generated in the case due to moving of the carriage.

23 Claims, 8 Drawing Sheets

LIQUID EJECTING APPARATUS

BACKGROUND OF THE INVENTION

1. Field of the Invention

The present invention relates to a liquid ejecting apparatus for ejecting a liquid drop from a nozzle opening of a liquid jet head to an article to be processed.

2. Description of the Related Art

As a typical example of a conventional liquid ejecting apparatus, there is an ink jet recording apparatus having an inkjet recording head for recording images. As other liquid ejecting apparatus, for example, an apparatus having a color material jet head used for manufacturing color filters of liquid crystal displays, an apparatus having an electrode material (conductive paste) jet head used for forming electrodes of organic EL displays and face emission displays (FED), an apparatus having a biological organic substance jet head used for manufacturing biological chips, and an apparatus having a sample jet head as a precise pipette may be cited.

An ink jet recording apparatus as a typical example of the liquid ejecting apparatus has been recently used in many printings including color printings because printing noise is comparatively low and small dots can be produced highly densely.

Such an ink jet recording apparatus generally has an ink jet recording head moving back and forth in the width direction (head scanning direction) of a recording medium (an article to be processed) loaded on a carriage such as recording paper and a feed mechanism for moving a recording medium in the direction (feed direction) perpendicular to the head scanning direction and further has a platen which is arranged opposite to the recording head, supports the recording medium fed by the feed mechanism from the back side, and specifies the position of the recording medium with respect to the recording head.

The ink jet recording apparatus prints by ejecting ink drops onto recording media by the recording head in correspondence with print data. And, the recording head loaded on the carriage can eject ink in various colors, for example, black, yellow, cyan, and magenta, thus not only text printing can be realized by black ink but also full-color printing can be realized by changing the ejection rate of each ink.

When the overall surface of each recording medium is to be printed free of blanks on the edges of the recording medium (so-called four-side edge-free printing) by the ink jet recording apparatus, in consideration of an allowance for displacements of the recording medium and carriage, an area slightly wider than the size of the recording medium is printed.

Namely, in order to make it possible that the surface of the recording medium can be printed free of blanks on the left and right edges (edges in the feed direction) of the recording medium, the scanning range of the recording head during printing can be set wider so as to extend beyond the side edges of the recording medium.

Furthermore, when the surface is to be printed free of blanks on the front and rear edges (edges in the head scanning direction) of the recording medium, at the start time of printing the recording medium, up to an area extending beyond the front edge of the recording medium is designated as an area to be printed and also at the end time of printing the recording medium, up to an area extending beyond the rear edge of the recording medium is designated as an area to be printed.

And, ink drops ejected into the areas beyond the recording medium are absorbed by an absorbent member (sponge, etc.) arranged on the rear side of the recording medium opposite to the recording head.

However, the ink absorbent member is arranged on the rear side of the recording medium away from the same and the distance from the nozzle opening to the ink absorbent member is longer than the distance from the nozzle opening to the recording medium. Therefore, when ink drops are ejected into an area outside the recording medium, the ink drops ejected from the nozzle opening slow down upon receipt of the air resistance and may be misted before reaching the ink absorbent member. Particularly, when the volume (weight) of ink drops is made smaller so as to improve the image quality, the speed reduction degree due to the air resistance is increased and ink drops are apt to be misted.

Further, the inside of the ink jet recording apparatus is an almost enclosed space surrounded by a case, so that when the carriage moves in the head scanning direction, at the same time that air is pushed out by the moved carriage, air flows in the part where the carriage passes through. As a result, forward and downward the carriage in the moving direction, a descending air stream is generated, while backward and downward the carriage, air is flown up and an ascending air stream is generated. FIG. 16 is a drawing showing the flow of wind (air stream) when a carriage 101 having a recording head 100 moves to the left on the paper surface. Further, in FIG. 16, a numeral 102 indicates recording paper.

Further, due to the movement of the carriage 101, not only forward and backward in the moving direction of the carriage 101 but also downward in the left and right directions, an ascending air stream is generated. Further, in FIG. 17, numeral 103 indicates platens for supporting the recording paper 102 from the rear thereof.

Ink drops misted before reaching the ink absorbent member, as shown in FIGS. 16 and 17, splash around on the wind generated due to the movement of the carriage 101 and the majority of ink mist is applied to projections (commonly called diamond ribs) 104 making contact with the rear of the recording paper 102 so as to support the recording paper 102. The diamond ribs 104 always rub against the recording paper 102, thereby is easily charged with static electricity and easily attract ink mist by the attraction force due to the static electricity.

When ink mist is deposited on the diamond ribs 104 like this, the deposited ink mist is applied to the rear of the recording paper 102, thus stripe-shaped strains may be generated on the rear of the recording paper 102. Such stains on the rear of the recording paper 102 cause a problem particularly in printing of both sides and postal card print.

SUMMARY OF THE INVENTION

The present invention was developed with the foregoing in view and is intended to provide a liquid ejecting apparatus, when liquid drops are to be fed free of blanks on the edges of an article to be processed and even when liquid drops to be ejected are made smaller in diameter, capable of preventing the article to be processed from staining due to misted liquid drops.

A liquid ejecting apparatus of the present invention comprises: a liquid jet head including a nozzle opening through which a liquid drop is ejected by changing pressure of a liquid in a pressure chamber interconnecting to said nozzle opening; a scanning mechanism including a carriage on which said liquid jet head is loaded, said scanning mechanism moves said liquid jet head in a head scanning direction together with said carriage; a case configured to contain said liquid jet head and said scanning mechanism; and leading means for leading a liquid drop, which is ejected from said liquid jet head and not applied to an article to be processed, in a given direction using an air stream generated in said case due to moving of said carriage.

Preferably, the liquid ejecting apparatus further comprises: an absorbent member for absorbing said liquid drop led by said leading means in said given direction.

Preferably, the liquid ejecting apparatus further comprises: a feed mechanism for feeding said article to be processed in a feed direction perpendicular to said head scanning direction; and a support member arranged opposite to said liquid jet head, said support member supporting said article to be processed, which is fed by said feed mechanism, from a rear of said article so as to specify a position of said article to be processed with respect to said liquid jet head, wherein: said feed mechanism and said support member are contained in said case together with said liquid jet head and said scanning mechanism, and said leading means has an air hole passing through said support member.

Preferably, said support member has a plurality of projections in contact with said rear of said article to be processed, and said air hole is formed in a neighborhood of said projections.

Preferably, said support member has a flat plate portion on which said plurality of projections are formed and a concave portion in which an absorbing member for receiving and absorbing a liquid drop ejected into an area outside said article to be processed is arranged, and said air hole is positioned between said projections, which are arranged in said head scanning direction, and formed at least in said flat plate portion.

Preferably, said flat plate portion has three longitudinal parts which are extended in said head scanning direction and separated from each other in said feed direction, said air hole being formed in said longitudinal parts other than a central longitudinal part among said three longitudinal parts.

Preferably, an absorbent member for absorbing a liquid drop is installed under said air hole on a rear side of said support member.

Preferably, said leading means has a carriage through-pass extending inside said carriage in said head scanning direction.

Preferably, the liquid ejecting apparatus further comprises: an absorbent member for absorbing liquid drops in said carriage through-path.

Preferably, said absorbent member in said carriage through-path is disposed on at least a part of an inner wall of said carriage through-path.

Preferably, said absorbent member in said carriage through-path comprises an air permeable absorbent material for sealing said carriage through-path.

Preferably, the liquid ejecting apparatus comprises a pair of said absorbent members which are arranged in respective positions slightly on a center side from openings at both ends of said carriage through-path.

Preferably, an air stream guide member for leading an air stream generated due to moving of said carriage to openings at both ends of said carriage through-path is installed in said carriage.

Preferably, said carriage through-path is arranged so as to be opened at edges of front and rear faces of said carriage in said head scanning direction, and said air stream guide member has central convex portions formed at centers of said front and rear faces of said carriage and peripheral convex portions formed around said central convex portions, wherein: said central convex portions include slant faces lowering in height toward said peripheral convex portions.

Preferably, said carriage through-path includes a tubular member arranged in said carriage.

Preferably, the liquid ejecting apparatus further comprises: a static electricity charged member arranged on a surface parallel with said head scanning direction in said case; and a static electricity generation member installed on said carriage so as to make contact with said static electricity charged member when moving together with said carriage, and generate static electricity.

Preferably, said case has left and right side walls arranged opposite to each other in said head scanning direction, and air holes capable of ventilating between an inside and an outside of said case are formed in said left and right side walls.

Preferably, wind controlling plates projected in said head scanning direction are installed on lower portions of said front and rear faces of said carriage in said head scanning direction.

A liquid ejecting apparatus of the present invention comprises: a liquid jet head including a nozzle opening through which a liquid drop is ejected by changing pressure of a liquid in a pressure chamber interconnecting to said nozzle opening; a scanning mechanism including a carriage on which said liquid jet head is loaded, said scanning mechanism moves said liquid jet head in a head scanning direction together with said carriage; and a case configured to contain said liquid jet head and said scanning mechanism; wherein: wind controlling plates projected in said head scanning direction are installed on lower portions of said front and rear faces of said carriage in said head scanning direction.

Preferably, the liquid ejecting apparatus further comprises: a feed mechanism for feeding an article to be processed in a feed direction perpendicular to said head scanning direction; and a support member arranged opposite to said liquid jet head, said support member supporting said article to be processed, which is fed by said feed mechanism, from a rear of said article, so as to specify a position of said article to be processed with respect to said liquid jet head.

Preferably, the liquid ejecting apparatus further comprises: a static electricity charged member arranged on a surface parallel with said head scanning direction in said case; and a static electricity generation member installed on said carriage so as to make contact with said static electricity charged member when moving together with said carriage, and generate static electricity.

Preferably, said case has left and right side walls arranged opposite to each other in said head scanning direction and air holes capable of ventilating between an inside and an outside of said case are formed in said left and right side walls.

A liquid ejecting apparatus of the present invention comprises: a liquid jet head including a nozzle opening through which a liquid drop is ejected by changing pressure of a liquid in a pressure chamber interconnecting to said nozzle opening; a scanning mechanism including a carriage on which said liquid jet head is loaded, said scanning mechanism moves said liquid jet head in a head scanning direction together with said carriage; and a case configured to contain said liquid jet head and said scanning mechanism; wherein: said case has left and right side walls arranged opposite to each other in said head scanning direction, and air holes capable of ventilating between an inside and an outside of said case are formed in said left and right side walls.

Preferably, the liquid ejecting apparatus further comprises: a feed mechanism for feeding said article to be processed in a feed direction perpendicular to said head scanning direction; and a support member arranged opposite to said liquid jet head, said support member supporting said article to be processed, which is fed by said feed mechanism, from a rear of said article so as to specify a position of said article to be processed with respect to said liquid jet head.

Preferably, the liquid ejecting apparatus further comprises: a static electricity charged member arranged on a surface parallel with said head scanning direction in said case; and a static electricity generation member installed on said carriage so as to make contact with said static electricity charged member when moving together with said carriage, and generate static electricity.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

An ink jet recording apparatus as an embodiment of the liquid ejecting apparatus of the present invention will be explained hereunder with reference to the accompanying drawings.

The ink jet recording apparatus of this embodiment has an ink jet recording head (a kind of liquid jet head) configured to cause a pressure change in ink in a pressure chamber by a pressure generation element installed in correspondence with the pressure chamber interconnecting to a nozzle opening and ejecting ink drops from the nozzle opening. As a pressure generation element, for example, a piezo-vibrator may be used.

Figure 1:
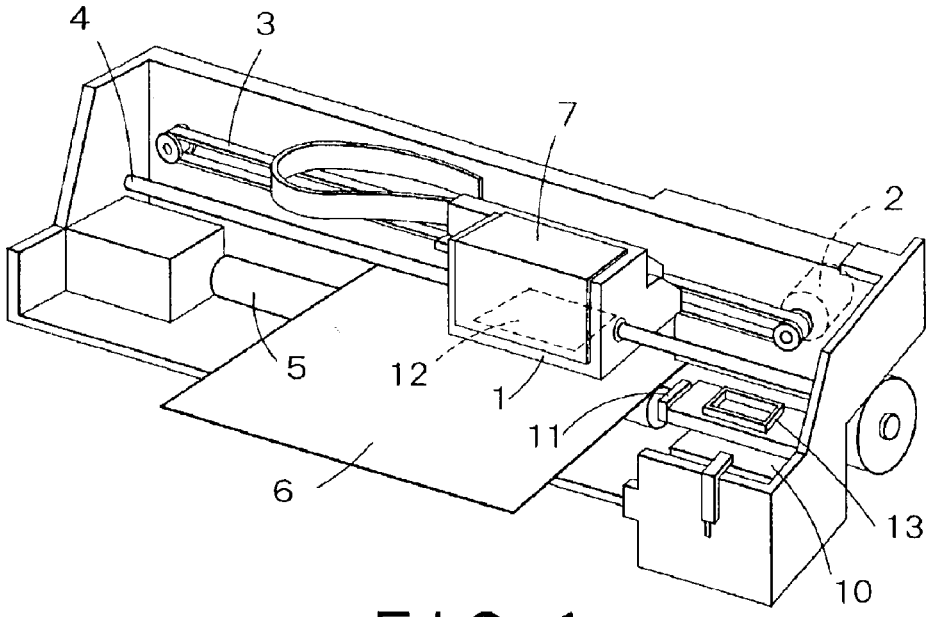
FIG. 1 is a perspective view showing the schematic constitution of an ink jet recording apparatus as an embodiment of the liquid ejecting apparatus of the present invention.
Figure 2:
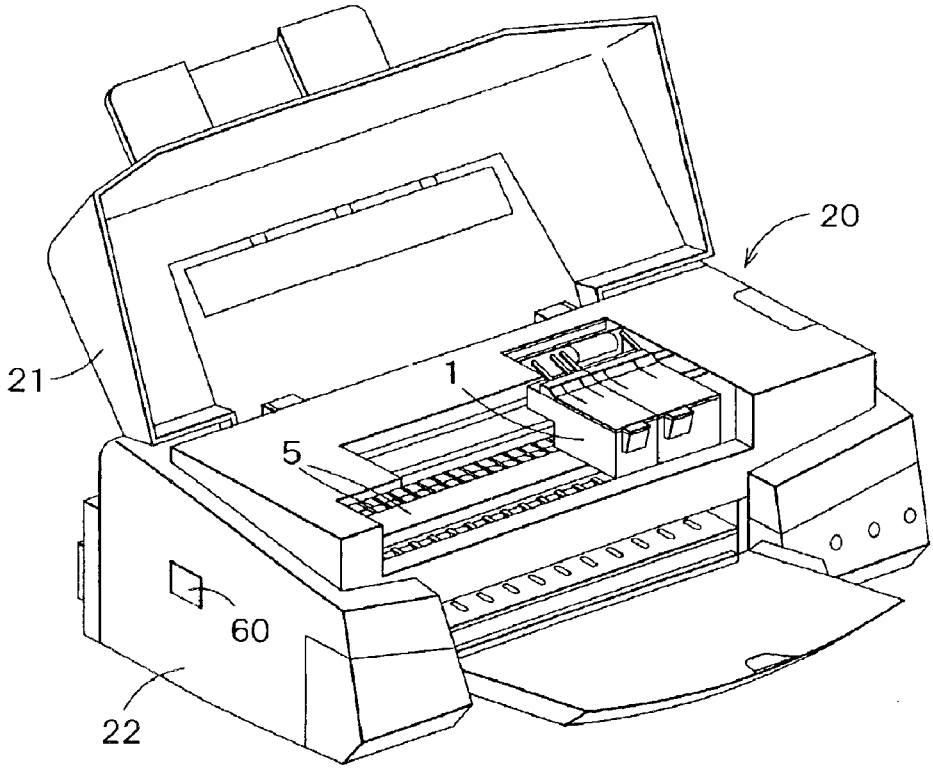
FIG. 2 is another perspective view showing the schematic constitution of an ink jet recording apparatus as an embodiment of the liquid ejecting apparatus of the present invention.
Figure 3:
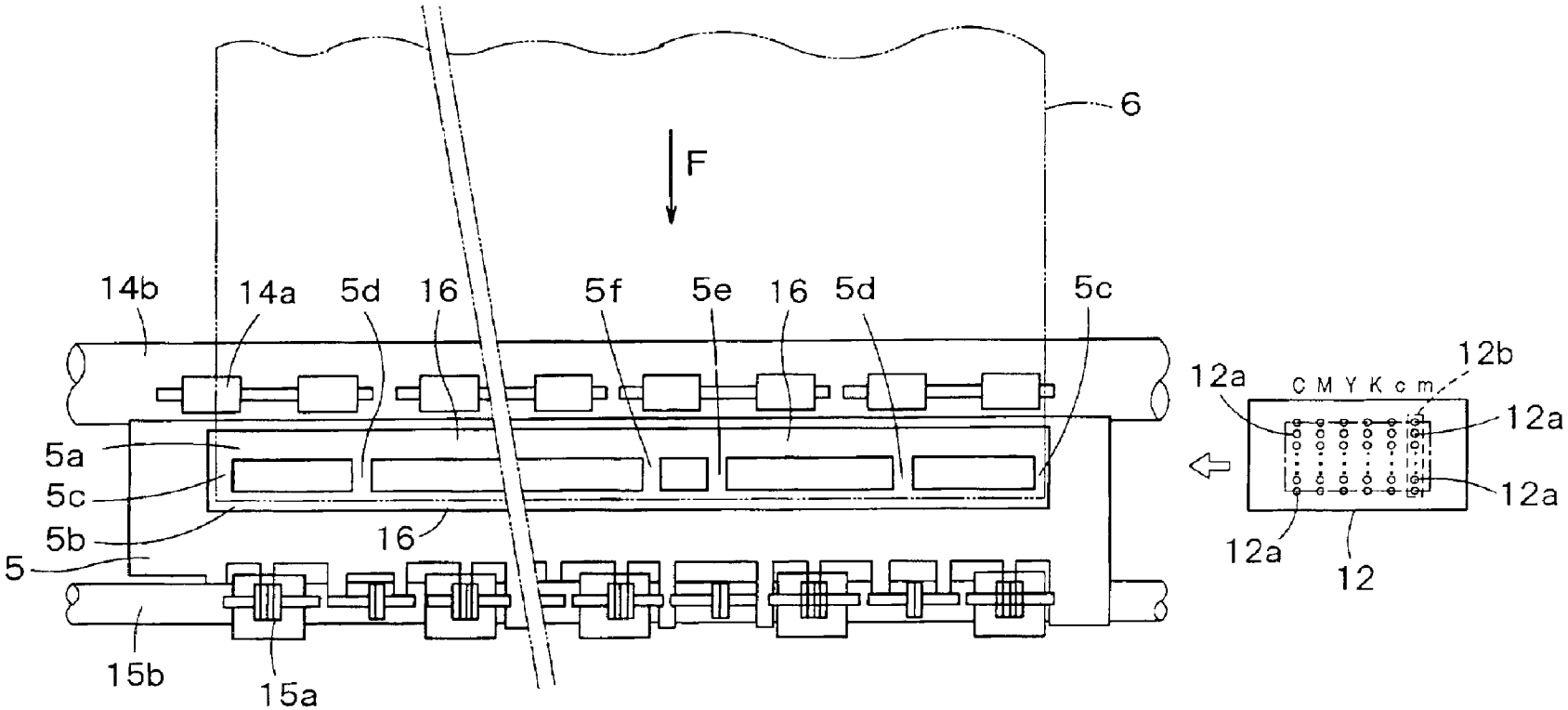
FIG. 3 is a plan view showing the platen and its periphery of the ink jet recording apparatus shown in FIGS. 1 and 2 which are enlarged.

FIGS. 1 and 2 are perspective views showing the schematic constitution of the ink jet recording apparatus of this embodiment and FIG. 3 is a drawing showing the enlarged platen and its circumference of the ink jet recording apparatus. In FIG. 1, numeral 1 indicates a carriage and the carriage 1 is structured so as to be guided by a carriage shaft 4 which is a guide member via a timing belt 3 driven by a carriage motor 2 and move back and force in the axial direction (the head scanning direction) of a platen 5. The platen 5 is a support member for supporting recording paper 6 (a kind of article to be processed) from the rear thereof and specifying the position of the recording paper 6 with respect to a recording head 12.

The carriage 1, carriage motor 2, timing belt 3, and carriage shaft 4 constitute the scanning mechanism for letting the ink jet recording head 12 scan in the head scanning direction together with the carriage 1.

The ink jet recording head 12 has a plurality of pressure chambers 12*b* interconnecting respectively to a plurality of nozzle openings and is loaded on the side of the carriage 1 opposite to the recording paper 6. Further, on the carriage 1, an ink cartridge 7 for feeding ink to the recording head 12 is mounted in a removable state.

In the home position (the right side of FIG. 1) which is a non-printing area of the ink jet recording apparatus, a cap member 13 is arranged and the cap member 13 is structured, when the recording head 12 loaded on the carriage 1 moves to the home position, so as to be pressed against the nozzle forming surface of the recording head 12 and form a closed space between itself and the nozzle forming surface. And, under the cap member 13, a pump unit 10 for giving negative pressure to the closed space formed by the cap member 13 is arranged.

In the neighborhood of the cap member 13 on the printing area side, a wiping means 11 having an elastic plate such as rubber is arranged so as to move back and forth, for example, in the horizontal direction to the moving track of the recording head 12 and structured so as to wipe out the nozzle forming surface of the recording head 12 as required when the carriage 1 moves back and forth on the side of the cap member 13.

The ink jet recording apparatus of this embodiment further has a feed mechanism 40 for intermittently feeding the recording paper 6 to be printed by the recording head 12 in the direction perpendicular to the head scanning direction.

As shown in FIG. 3, the feed mechanism has paper feed rollers 14*a* and 14*b* arranged opposite to each other so as to hold and feed the recording paper 6 onto the platen 5 and paper ejection rollers 15*a* and 15*b* arranged opposite to each other so as to eject the printed recording paper 6. The paper feed rollers 14*a* and paper ejection rollers 15*a* are follower rollers and the paper feed roller 14*b* and paper ejection roller 15*b* are drive rollers.

As shown in FIG. 3, in the platen 5, a plurality of ink receiving longitudinal parts 5*c*, 5*d*, 5*e*, and 5*f* extending in the direction parallel to the paper feed direction (feed direction) F and a plurality of ink receiving horizontal parts 5*a* and 5*b* extending in the head scanning direction perpendicular to the paper feed direction F are formed.

Among the plurality of ink receiving longitudinal parts 5*c*, 5*d*, 5*e*, and 5*f*, *a* pair of ink receiving longitudinal parts 5*c* are arranged so that the left and right ends of the recording paper 6 of A3 size respectively pass right above them, and other pair of ink receiving longitudinal parts 5*d* are arranged so that the left and right ends of the recording paper 6 of B4 size respectively pass right above them, and other pair of ink receiving longitudinal parts 5*e* are arranged so that the left and right ends of the recording paper 6 of A4 size respectively pass right above them, and other pair of ink receiving longitudinal parts 5*f* are arranged so that the left and right ends of the recording paper 6 of B5 size respectively pass right above them.

Further, the plurality of ink receiving horizontal parts 5*a* and 5*b* are composed of a paper feed side ink receiving horizontal part 5*a* arranged on the paper feed side and a paper ejection side ink receiving horizontal part 5*b* arranged on the paper ejection side.

In these ink receiving parts 5*a*, 5*b*, 5*c*, 5*d*, 5*e*, and 5*f*, absorbent members 16 are respectively arranged so as to absorb ink ejected from the recording head 12. The ink absorbent members 16 can be formed by sponge.

As shown in FIG. 2, the scanning mechanism including the carriage 1 on which the recording head 12 is loaded, the feed mechanism, and the platen 5 are stored in a case 20 composed of a cover 21 and a housing 22.

Figure 4:
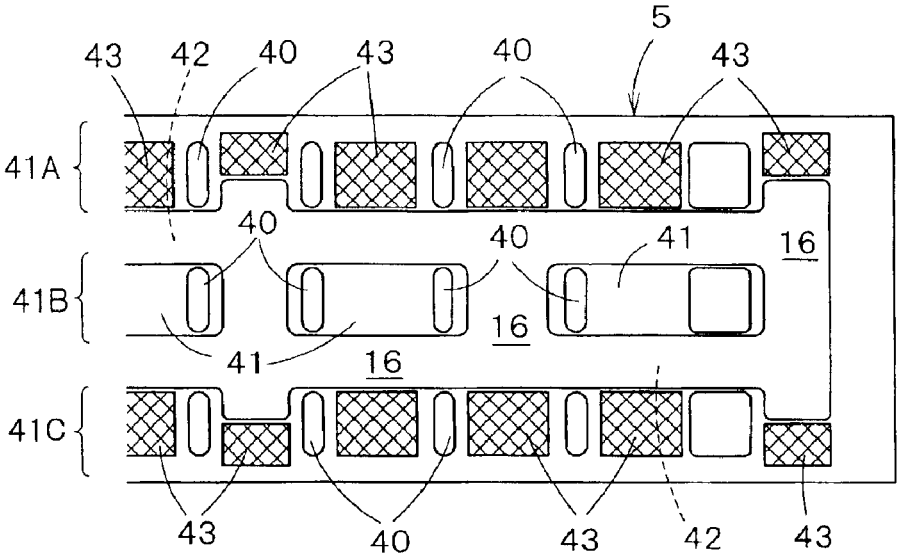
FIG. 4 is a plan view showing a part of the platen shown in FIG. 3 which is enlarged.
Figure 5:
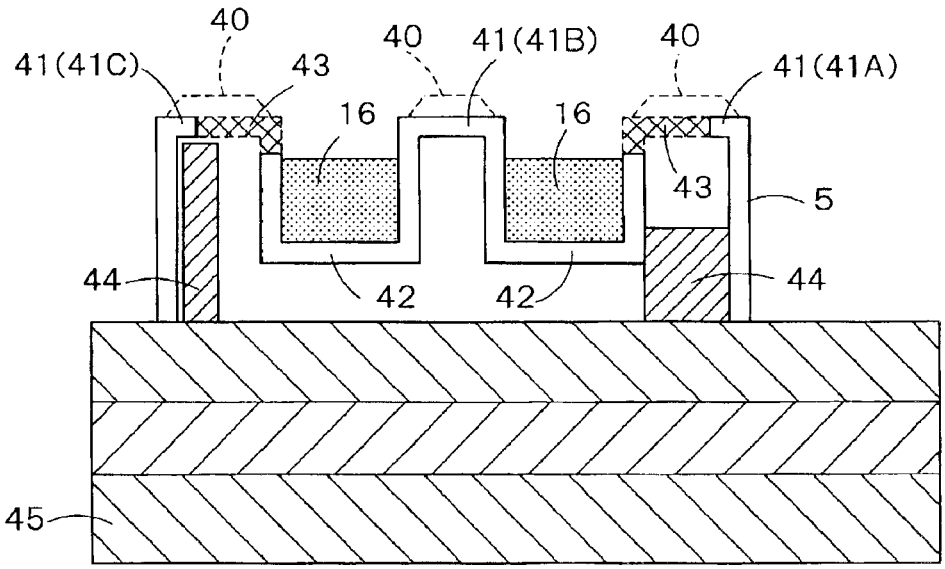
FIG. 5 is a longitudinal cross sectional view showing the platen and its lower part shown in FIG. 3 which are enlarged.

FIG. 4 is a plan view showing a part of the platen 5 which is enlarged and FIG. 5 is a sectional view of the platen 5 and the lower part thereof. As shown in FIGS. 4 and 5, the platen 5 has flat plate portions 41 on which a plurality of diamond ribs (projections) 40 are projected and concave portions 42 which are formed integratedly with the flat plate portions 41 and provided with ink absorbent members 16 for receiving ink drops ejected into an area outside the recording paper 6. The diamond ribs 40 make contact with the rear of the recording paper 6 and support the recording paper 6 at a predetermined position.

And, as shown in FIGS. 4 and 5, in the platen 5, a plurality of air holes passing through the front and rear sides thereof are formed in the neighborhood of the diamond ribs 40. More concretely, the air holes are formed respectively between the diamond ribs 40 arranged in the head scanning direction. The respective air holes 43 are mostly formed in the flat plate portions 41, though a part thereof is extended up to the curved plates 42. The air holes 43 constitute a leading means for leading ink drops, which are ejected from the recording head 12 and not applied to the recording paper 6, in a given direction using an air stream generated in the case 20 in correspondence with moving of the carriage 1.

Further, the flat plate portions 41 have three longitudinal parts 41A, 41B, and 41C which are extended in the head scanning direction and arranged away from each other and the air holes 43 are formed in the longitudinal parts 41A and 41C other than the central longitudinal part 41B among the three longitudinal parts 41A, 41B, and 41C. In this case, the reason that no air hole is formed in the central longitudinal part 41B is that there is the possibility that when an air hole is formed in this part, during printing the front and rear edges of the recording paper 6 in the feed direction, ink drops which are originally expected to reach the ink absorbent members 16 may also be blown off and misted.

Furthermore, in this embodiment, as shown in FIG. 5, under the air holes 43 on the rear side of the platen 5, ink absorbent members 44 are installed. The ink absorbent members 44 are connected to a waste liquid absorbent material 45 arranged under the platen 5.

Figure 6:
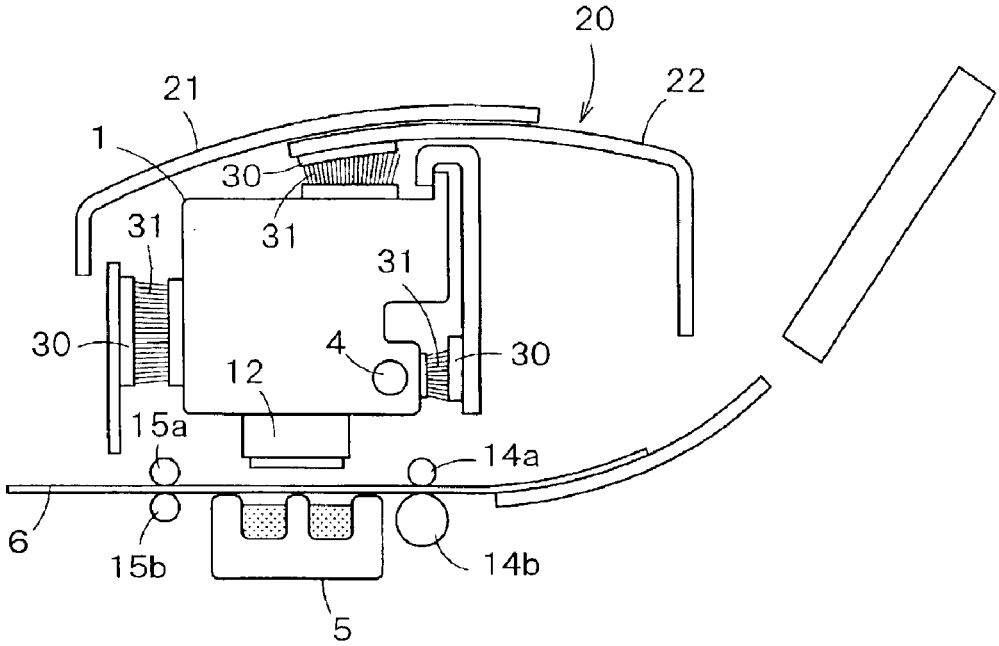
FIG. 6 is a drawing showing the carriage and its periphery of the ink jet recording apparatus shown in FIGS. 1 and 2 which are enlarged.

Furthermore, in this embodiment, as shown in FIG. 6, in the case 20, a plurality of laminal static electricity charged members 30 formed by a material which is easily charged with static electricity are installed and the static electricity charged members 30 are arranged on the face parallel with the head scanning direction. Concretely, the static electricity charged members 30 are installed on the respective inner faces of the ceiling board and front wall of the housing 22 and the face of the vertical wall installed on the rear side of the recording head 1. The static electricity charged members 30 can be formed by a plastic sheet composed of acrylic resin, polyester, or polyvinyl chloride.

Furthermore, in the carriage 1, a plurality of brush-shaped static electricity generation members 31 formed by a material which easily generates static electricity are installed. The static electricity generation members 31 can be formed by rayon, nylon, wool, or hair. The static electricity members 31, when moving together with the carriage 1, are rubbed against the static electricity charged members 30.

Figure 7:
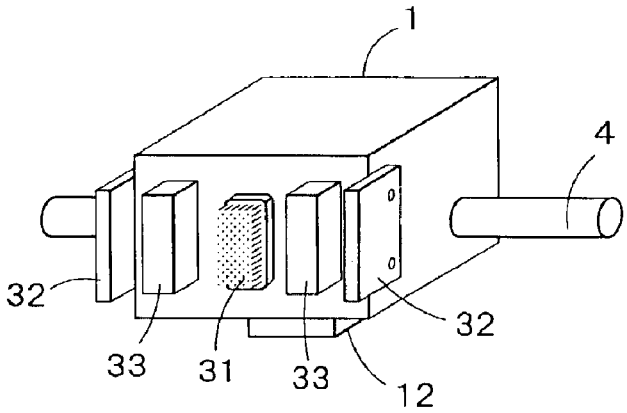
FIG. 7 is a drawing showing the carriage of the ink jet recording apparatus shown in FIGS. 1 and 2 which is enlarged.

Further, as shown in FIG. 7, wiper members 32 composed of a rubber plate are installed on the carriage 1 on both sides of each of the static electricity generation members 31 in the head scanning direction. The wiper members 32, during moving together with the carriage 1, make contact with the static electricity charged members 30, thereby can wipe off ink from the static electricity charged members 30. The wiper members 32 move up to both ends of the inside of the apparatus together with the carriage 1 and ink wiped off by the wiper members 32 flows down at both ends of the inside of the apparatus.

Furthermore, on both sides of each of the static electricity generation members 31 in the head scanning direction, between each of the static electricity generation members 31 and each of the wiper members 32, an ink absorbent member 33 composed of sponge is installed. The ink absorbent members 33, during moving together with the carriage 1, make contact with the static electricity charged members 30, thereby can absorb ink from the static electricity charged members 30. By doing this, ink which cannot be wiped off by the wiper members 32 can be absorbed and removed by the ink absorbent members 33.

Figure 8:
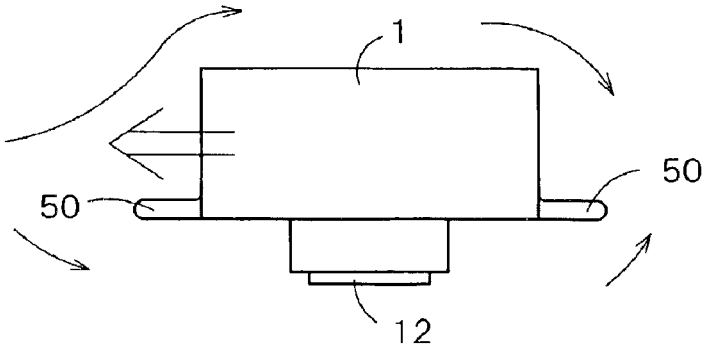
FIG. 8 is a front view showing the carriage and recording head of the ink jet recording apparatus shown in FIGS. 1 and 2 which are enlarged.

Further, in this embodiment, as shown in FIG. 8, on the lower parts of the front and rear faces of the carriage 1 in the head scanning direction, wind controlling plates 50 are preferably projected in the head scanning direction.

Further, as a varied example, the carriage 1 having the wind controlling plates 50 can be adopted in an ink jet recording apparatus having a general platen 5 with no air holes 43.

Figure 9:
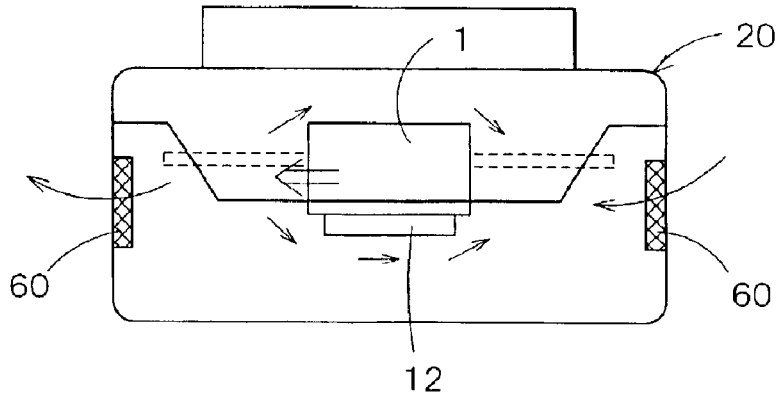
FIG. 9 is a front view showing the outline of the ink jet recording apparatus shown in FIGS. 1 and 2.

Further, in this embodiment, as shown in FIGS. 2 and 9, air holes 60 capable of ventilating between the inside and the outside of the case 20 are preferably formed in the left and right side walls of the case 20.

Further, as a varied example, the constitution that the air holes 60 are formed in the left and right side walls of the case 20 can be adopted in an ink jet recording apparatus having a general platen 5 with no air holes 43 or an ink jet recording apparatus having a general carriage 1 having no wind controlling plates 50.

Figure 10:
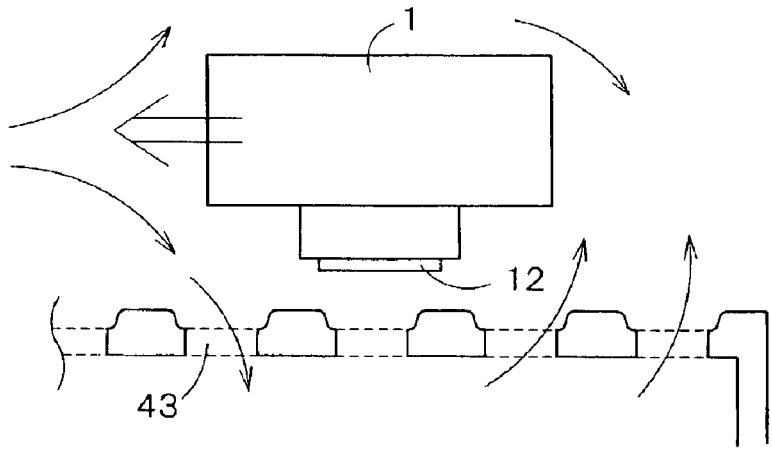
FIG. 10 is a longitudinal cross sectional view for explaining the situation of a wind stream (air stream) generated around the carriage of the ink jet recording apparatus shown in FIGS. 1 and 2 which is viewed from the front.

And, according to this embodiment having the aforementioned constitution, the air hoes 43 are formed in the platen 5 in the neighborhood of the diamond ribs 40, so that during moving of the carriage 1 in the head scanning direction, a descending air stream generated forward and downward in the moving direction of the carriage 1, as shown in FIG. 10, flows on the rear side of the platen 5 via the air holes 43. On the other hand, by an ascending air stream generated backward and downward the carriage 1, air is blown out from the air holes 43, thus the ascending air stream backward the carriage 1 increases in strength.

Figure 11:
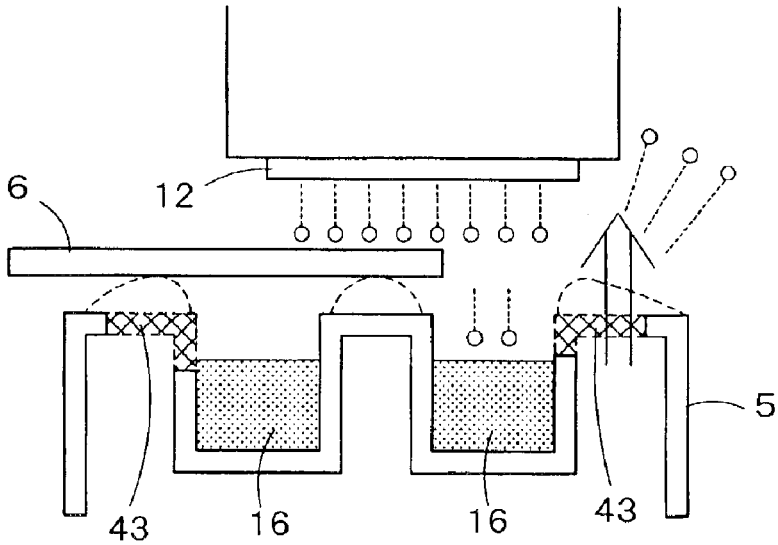
FIG. 11 is a longitudinal cross sectional view for explaining the situation of a wind stream (air stream) generated around the carriage of the ink jet recording apparatus shown in FIGS. 1 and 2 which is viewed from the side.

Further, FIG. 11 is a draw showing the carriage 1 which is viewed in the head scanning direction and as shown in FIG. 11, downward in the transverse direction perpendicular to the head scanning direction which is the moving direction of the carriage 1, a strong ascending stream also is formed by air blown out from the air holes 43.

As shown in FIGS. 10 and 11, an air stream is generated via the air holes 43 due to moving of the carriage 1, so that forward the carriage 1, by a descending air stream sucked into the air holes 43, ink mist is sucked into the air holes 43 or forcibly descended toward the ink absorbent members 16 and backward the carriage 1, ink mist is forcibly blown off by an ascending air stream blown out from the air holes 43. By doing this, the diamond ribs 40 of the platen 5 can be prevented from attaching of ink mist.

Further, according to this embodiment, ink mist sucked from the air holes 43 is absorbed by ink absorbent members 44 arranged under the air holes 43, so that ink mist passing through the air holes 43 can be prevented from re-floating in the apparatus.

Further, in this embodiment, under the front and rear faces of the carriage 1 in the head scanning direction, the wind controlling plates 50 are preferably installed, so that the majority of a wind generated due to moving of the carriage 1 flows on the top side of the carriage 1, thus the amount of wind flowing on the bottom side of the carriage 1 can be reduced. By doing this, ink drops can be prevented from misting by a wind generated due to moving of the carriage 1.

Further, in this embodiment, the air holes 60 are preferably formed in the left and right side walls of the case 20, so that when the carriage 1 moves, air comes in and out from the case 20 via the air holes 60. Therefore, the amount of wind generated around the carriage 1 due to moving of the carriage 1 is reduced, thus ink drops can be prevented from misting.

Further, in this embodiment, during movement of the carriage 1 in the head scanning direction, the static electricity generation members 31 are rubbed against the static electricity charged members 30 and static electricity generated by it is charged on the static electricity charged members 30. Ink drops which are misted and float inside the case 20 are attracted by the attraction force of the static electricity charged on the static electricity charged members 30 and seized on the surfaces of the static electricity charged members 30. As a result, even when ink mist floats in the apparatus, the inside of the apparatus is kept away from staining and failure.

Further, in this embodiment, during movement of the carriage 1 in the head scanning direction, the surfaces of the static electricity charging members 30 are cleaned by the wipers 32 and the ink absorbent members 33, so that the static electricity charged members 30 can be prevented from soiling by ink and hardly charging.

Next, another embodiment of the liquid jet recording apparatus of the present invention will be explained by referring to FIGS. 12 to 14.

In this embodiment, in the carriage 1 of the ink jet recording apparatus shown in FIGS. 1 and 2, a leading means for leading ink drops, which are ejected from the recording head 12 and not applied to the recording paper 6 (article to be processed), in a given direction using an air stream generated in the case 20 due to moving of the carriage 1 is installed. Further, the leading means in this embodiment may be combined with the constitution of the aforementioned embodiment shown in FIGS. 3 to 8 or may be used independently.

Figure 12:
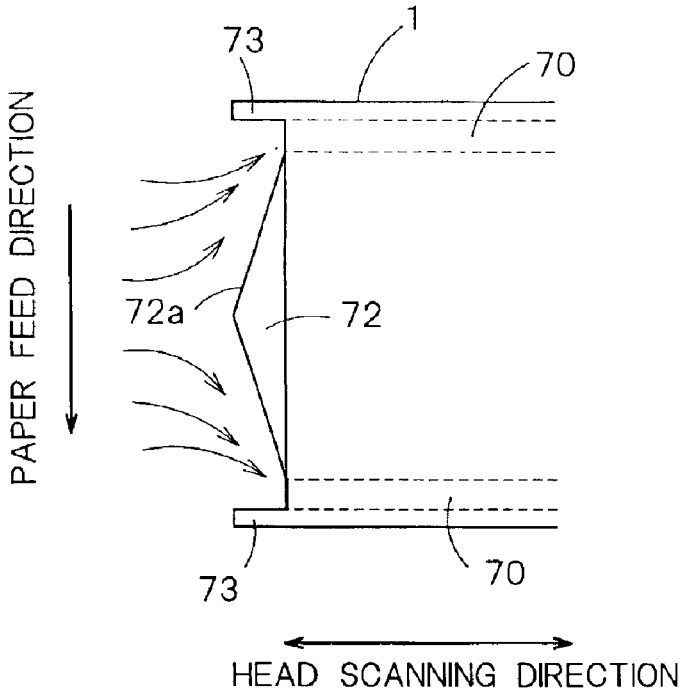
FIG. 12 is a top view showing the carriage and leading means of an ink jet recording apparatus as another embodiment of the liquid ejecting apparatus of the present invention which are enlarged.
Figure 13:
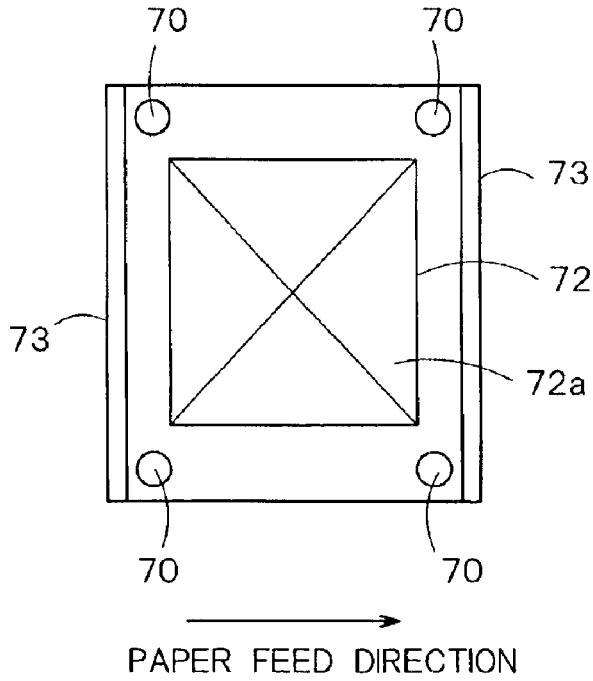
FIG. 13 is a side view of the carriage and leading means of the embodiment shown in FIG. 12.

FIGS. 12 and 13 are a top view and a side view of the carriage 1 of this embodiment and as shown in the drawings, inside the carriage 1, tubular members 70 are arranged in correspondence with the corners of the front and rear faces of the carriage 1 in the head scanning direction. The tubular members 70 form carriage passing-through paths extending through the front and rear faces in the carriage 1 in the head scanning direction. The tubular members 70 are preferably mounted in the carriage 1 in an exchangeable state.

Figure 14:
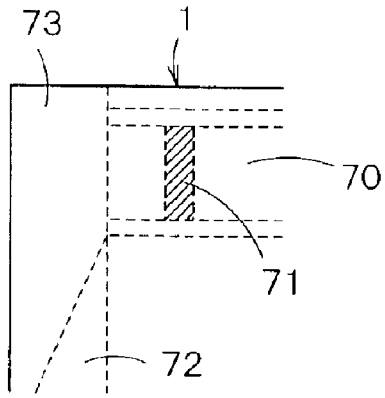
FIG. 14 is a drawing showing the carriage through-path formed in the carriage of the embodiment shown in FIG. 12 which is enlarged.

As shown in FIG. 14, in the tubular members 70, absorbent members 71 for absorbing misted ink drops are installed. The absorbent members 71 are composed of an air permeable absorbent material for sealing the insides of the tubular members 70 and arranged at the positions (the front side and rear side in the head scanning direction) slightly on the center side from the openings at both ends of the tubular members 70.

Further, as shown in FIGS. 12 and 13, central convex portions 72 are respectively formed at the centers of the front and rear faces of the carriage 1 and on the left and right sides of each of the central convex portions 72, peripheral convex portions 73 are formed. The central convex portions 72 include slant faces 72*a* lowering in height toward the peripheral convex portions 73. The central convex portions 72 and the peripheral convex portions 73 constitute an air stream guide member for leading an air stream generated due to moving of the carriage 1 to the openings at both ends of the carriage through-paths formed by the tubular members 70.

According to this embodiment having the aforementioned constitution, the carriage through-paths extending through the inside of the carriage 1 in the head scanning direction are formed by the tubular members 70, so that by the speed difference (flow resistance difference) between around the carriage 1 and inside the carriage through-paths, an air stream can be led into the carriage through-paths. Further, by the air stream guide member composed of the central convex portions 72 and the peripheral convex portions 73, the air stream can be effectively led to the openings at both ends of the carriage through-paths formed by the tubular members 60. Further, the absorbent members 71 are arranged in the positions slightly on the center side from the openings at both ends of the tubular members 70, so that the air stream led by the air stream guide member can be effectively led into the tubular members 70.

Therefore, in this embodiment, when the carriage 1 has no through-path, an uneven air stream is prevented from generating around the carriage 1 during moving, thus ink mist due to an uneven air stream generated around the carriage 1 can be prevented from flying and ink mist can be prevented from attaching to inside the apparatus and the ink cartridge 7. Further, the absorbent members 71 are installed in the tubular members 70, so that ink mist included in the air stream led into the carriage through-paths is seized by the absorbent members 71, thereby can be prevented from re-floating.

In this way, according to this embodiment, the recording paper 6 and the apparatus can be prevented from staining due to ink mist easily generated in correspondence with miniaturization of ink drops and execution of no-edge printing and moreover a short-circuit phenomenon due to ink attachment to electronic parts can be prevented.

Figure 15:
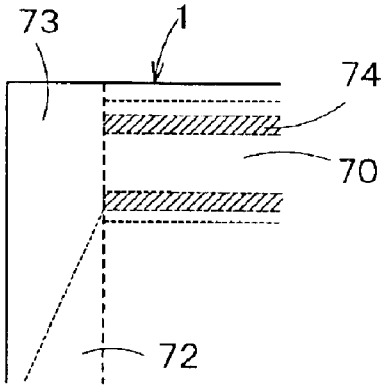
FIG. 15 is a drawing showing the carriage through-path formed in the carriage of a varied example of the embodiment shown in FIG. 12 which is enlarged.
Figure 16:
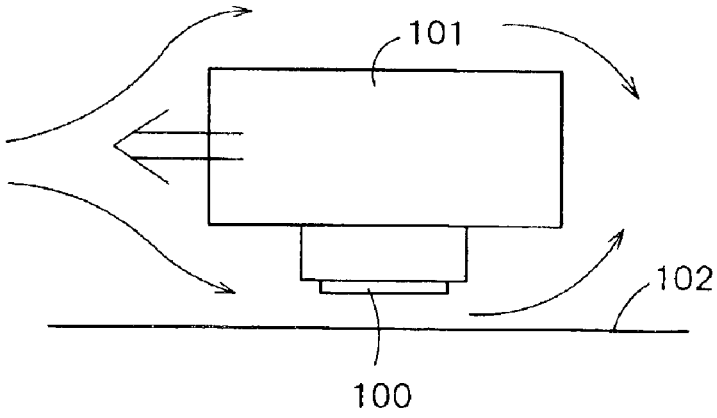
FIG. 16 is a front view for explaining the situation of a wind stream (air stream) generated around the carriage of a conventional ink jet recording apparatus.
Figure 17:
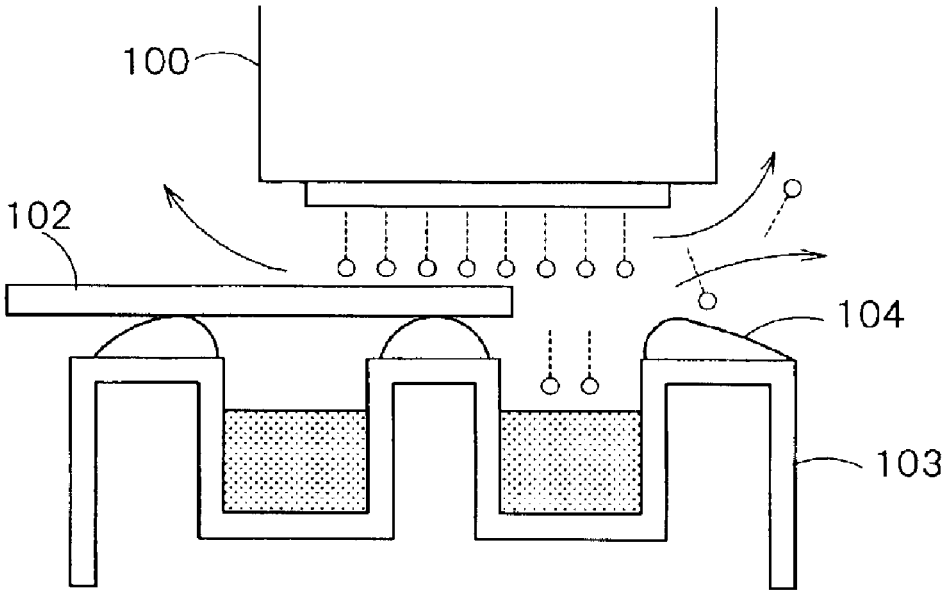
FIG. 17 is a longitudinal cross sectional view for explaining the situation of a wind stream (air stream) generated around the carriage of a conventional ink jet recording apparatus which is viewed from the side.

Further, as a varied example of this embodiment, in place of the absorbent members 71 shown in FIG. 14, as shown in FIG. 15, absorbent members 74 can be disposed on the inner wall surfaces of the tubular members 70. Also in this varied example, the same effect as that of the aforementioned embodiment can be obtained.

As mentioned above, according to the liquid ejecting apparatus of the present invention, even when liquid drops are to be fed free of blanks on the edges of an article to be processed or liquid drops to be ejected are made smaller in diameter, the article to be processed can be prevented from staining due to misted liquid drops.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A liquid ejecting apparatus comprising:

a liquid jet head including a nozzle opening through which a liquid drop is ejected by changing pressure of a liquid in a pressure chamber interconnecting to said nozzle opening;

a scanning mechanism including a carriage on which said liquid jet head is loaded, said scanning mechanism moves said liquid jet head in a head scanning direction together with said carriage;

a case configured to contain said liquid jet head and said scanning mechanism;

leading means for leading a liquid drop, which is ejected from said liquid jet head and not applied to an article to be processed, in a given direction using an air stream generated in said case due to moving of said carriage;

a feed mechanism for feeding said article to be processed in a feed direction perpendicular to said head scanning direction; and a support member arranged opposite to said liquid jet head, said support member supporting said article to be processed, which is fed by said feed mechanism, from a rear of said article so as to specify a position of said article to be processed with respect to said liquid jet head, wherein;

said feed mechanism and said support member are contained in said case together with said liquid jet head and said scanning mechanism, and said leading means has an air hole passing through said support member.

2. A liquid ejecting apparatus according to claim 1, further comprising:

an absorbent member for absorbing said liquid drop led by said leading means in said given direction.

3. A liquid ejecting apparatus according to claim 1, wherein:

said support member has a plurality of projections in contact with said rear of said article to be processed, and said air hole is formed in a neighborhood of said projections.

4. A liquid ejecting apparatus according to claim 1, wherein:

said support member has a flat plate portion on which said plurality of projections are formed and a concave portion in which an absorbing member for receiving and absorbing a liquid drop ejected into an area outside said article to be processed is arranged, and said air hole is positioned between said projections, which are arranged in said head scanning direction, and formed at least in said flat plate portion.

5. A liquid ejecting apparatus according to claim 4, wherein:

said flat plate portion has three longitudinal parts which are extended in said head scanning direction and separated from each other in said feed direction, said air hole being formed in said longitudinal parts other than a central longitudinal part among said three longitudinal parts.

6. A liquid ejecting apparatus according to claim 1, wherein:

an absorbent member for absorbing a liquid drop is installed under said air hole on a rear side of said support member.

7. A liquid ejecting apparatus according to claim 1, wherein:

said leading means has a carriage through-pass extending inside said carriage in said head scanning direction.

8. A liquid ejecting apparatus according to claim 7, further comprising:

an absorbent member for absorbing liquid drops in said carriage through-path.

9. A liquid ejecting apparatus according to claim 8, wherein:

said absorbent member in said carriage through-path is disposed on at least a part of an inner wall of said carriage through-path.

10. A liquid ejecting apparatus according to claim 8, wherein:

said absorbent member in said carriage through-path comprises an air permeable absorbent material for sealing said carriage through-path.

11. A liquid ejecting apparatus according to claim 10, comprising a pair of said absorbent members which are arranged in respective positions slightly on a center side from openings at both ends of said carriage through-path.

12. A liquid ejecting apparatus according to claim 7, wherein:

an air stream guide member for leading an air stream generated due to moving of said carriage to openings at both ends of said carriage through-path is installed in said carriage.

13. A liquid ejecting apparatus according to claim 12, wherein:

said carriage through-path is arranged so as to be opened at edges of front and rear faces of said carriage in said head scanning direction, and said air stream guide member has central convex portions formed at centers of said front and rear faces of said carriage and peripheral convex portions formed around said central convex portions, wherein:

said central convex portions include slant faces lowering in height toward said peripheral convex portions.

14. A liquid ejecting apparatus according to claim 7, wherein:

said carriage through-path includes a tubular member arranged in said carriage.

15. A liquid ejecting apparatus according to claim 1, further comprising:

a static electricity charged member arranged on a surface parallel with said head scanning direction in said case; and a static electricity generation member installed on said carriage so as to make contact with said static electricity charged member when moving together with said carriage, and generate static electricity.

16. A liquid ejecting apparatus according to claim 1, wherein:

said case has left and right side walls arranged opposite to each other in said head scanning direction, and air holes capable of ventilating between an inside and an outside of said case are formed in said left and right side walls.

17. A liquid ejecting apparatus according to claim 1, wherein:

wind controlling plates projected in said head scanning direction are installed on lower portions of said front and rear faces of said carriage in said head scanning direction.

18. A liquid ejecting apparatus comprising:

a liquid jet head including a nozzle opening through which a liquid drop is ejected by changing pressure of a liquid in a pressure chamber interconnecting to said nozzle opening;

a scanning mechanism including a carriage on which said liquid jet head is loaded, said scanning mechanism moves said liquid jet head in a head scanning direction together with said carriage;

a case configured to contain said liquid jet head and said scanning mechanism;

a static electricity charged member arranged on a surface parallel with said head scanning direction in said case; and a static electricity generation member installed on said carriage so as to make contact with said static electricity charged member when moving together with said carriage, and generate static electricity, wherein wind controlling plates projected in said head scanning direction are installed on lower portions of said front and rear faces of said carriage in said head scanning direction.

19. A liquid ejecting apparatus according to claim 18, further comprising:

a feed mechanism for feeding an article to be processed in a feed direction perpendicular to said head scanning direction; and a support member arranged opposite to said liquid jet head, said support member supporting said article to be processed, which is fed by said feed mechanism, from a rear of said article, so as to specify a position of said article to be processed with respect to said liquid jet head.

20. A liquid ejecting apparatus according to claim 18, wherein:

said case has left and right side walls arranged opposite to each other in said head scanning direction and air holes capable of ventilating between an inside and an outside of said case are formed in said left and right side walls.

21. A liquid ejecting apparatus comprising:

a liquid jet head including a nozzle opening through which a liquid drop is ejected by changing pressure of a liquid in a pressure chamber interconnecting to said nozzle opening;

a scanning mechanism including a carriage on which said liquid jet head is loaded, said scanning mechanism moves said liquid jet head in a head scanning direction together with said carriage; and a case configured to contain said liquid jet head and said scanning mechanism;

wherein:

said case has left and right side walls arranged opposite to each other in said head scanning direction, and air holes capable of ventilating between an inside and an outside of said case are formed in said left and right side walls so that air comes in and goes out through the air holes due to pressure fluctuation caused in said case when said carriage moves in said head scanning direction.

22. A liquid ejecting apparatus according to claim 21, further comprising:

a feed mechanism for feeding said article to be processed in a feed direction perpendicular to said head scanning direction; and a support member arranged opposite to said liquid jet head, said support member supporting said article to be processed, which is fed by said feed mechanism, from a rear of said article so as to specify a position of said article to be processed with respect to said liquid jet head.

23. A liquid ejecting apparatus according to claim 21, further comprising:

a static electricity charged member arranged on a surface parallel with said head scanning direction in said case; and a static electricity generation member installed on said carriage so as to make contact with said static electricity charged member when moving together with said carriage, and generate static electricity.

* * * * *